US005108101A

United States Patent [19]

Postula

[11] Patent Number: 5,108,101

[45] Date of Patent: Apr. 28, 1992

[54] METHOD OF PLAYING A LAG AND BUMP PUTTING GAME

[76] Inventor: Victor A. Postula, 307-½ West Michigan Ave., Marshall, Mich. 49068

[21] Appl. No.: 663,618

[22] Filed: Mar. 4, 1991

[51] Int. Cl.[5] ..... A63B 53/14

[52] U.S. Cl. ..... 273/176 FB

[58] Field of Search ..... 273/176 H, 176 J, 178 B, 273/179 R, 179 E, 180, 183 A, 195 K, 195 A, 195 B

[56] References Cited

U.S. PATENT DOCUMENTS

| | | | |
|---|---|---|---|
| 1,856,816 | 5/1932 | Luddy | 273/176 B |
| 2,384,723 | 9/1945 | Brodzik et al. | 273/170 J |
| 3,227,918 | 4/1973 | Zawacki | 273/176 FB |
| 3,584,877 | 6/1971 | Florlan | 273/176 FB |
| 3,727,917 | 4/1973 | MacLean | 273/176 H |
| 3,809,404 | 5/1974 | Fikse | 273/176 J |
| 3,856,313 | 12/1974 | Tierney | 273/176 FB |
| 3,944,232 | 3/1976 | Tierney | 273/176 J |
| 4,053,155 | 10/1977 | Williams | 273/180 |

*Primary Examiner*—Theatrice Brown
*Attorney, Agent, or Firm*—Richard C. Litman

[57] ABSTRACT

A golf putting game is played with regular golf balls and clubs on an elongated rectangular playing area. At the end of the playing area distal the putting lines is a shallow ramp. Several holes or depressions in the surface of the ramp, called "bunkers" in the game, act as ball traps. The playing area is conveniently made up in the form of a roll-up mat. The game itself has two phases. In phase one, the players attempt to putt balls into one of the bunkers to accumulate points. Phase two of the game has three embodiments, in all of which the players attempt to land their putts in one of the last three rectangles defined by the transverse lines to score. Bunker balls do not count in phase two. Score points are counted only at the end of a round of play in two of the embodiments, which encourages strategy and "bumping" of opponents' balls out of the score rectangles. The winning team is the first to reach a certain total score in two of the phase two embodiments, and is the team with the most points after eight rounds in the other.

9 Claims, 1 Drawing Sheet

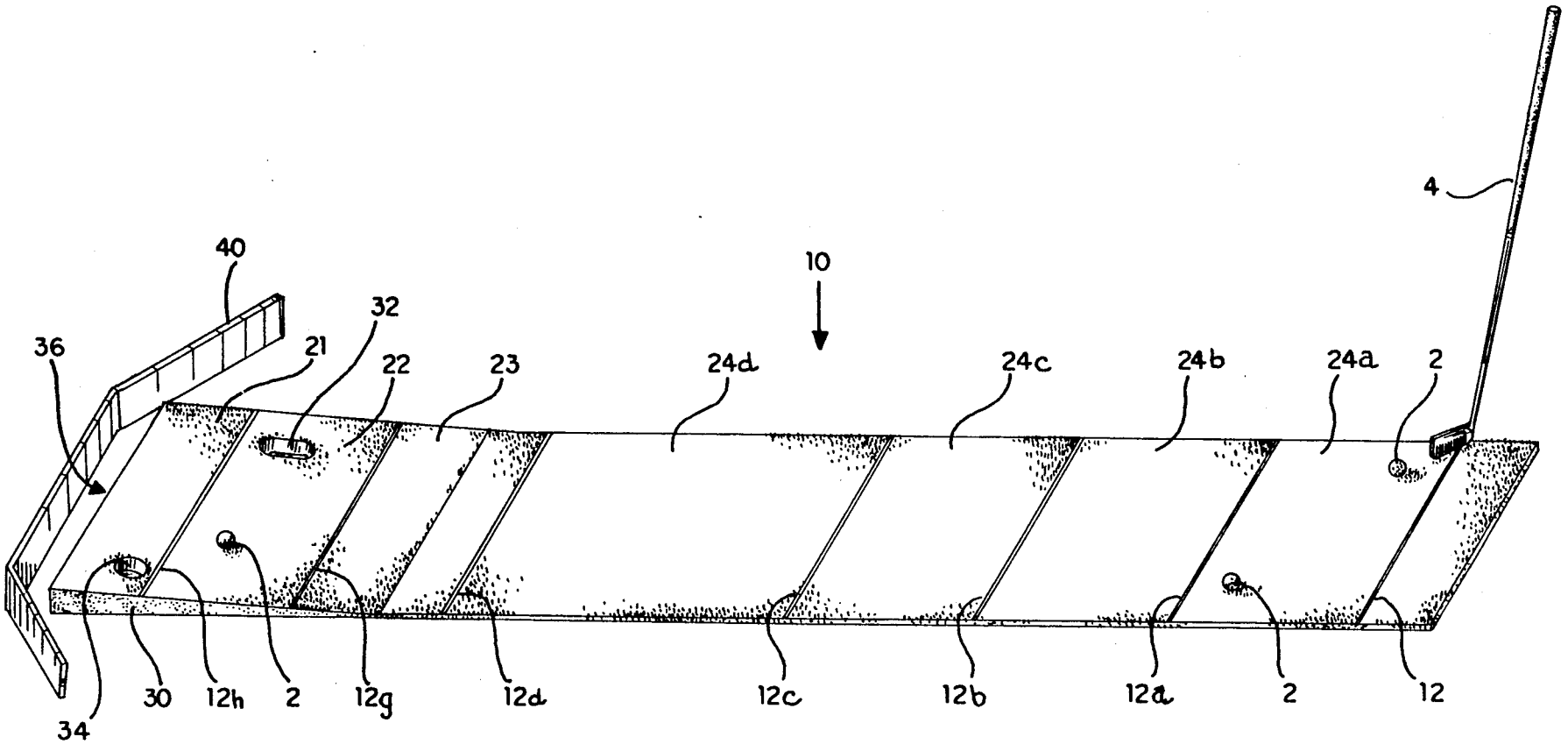
4
2
24a
24b
24c
24d
10
23
22
32
21
40
36
12
2
12a
12b
12c
12d
12g
2
12h
30
34

METHOD OF PLAYING A LAG AND BUMP PUTTING GAME

FIELD OF THE INVENTION

The present invention relates to a golf putting game using regular golf balls and clubs, and a device for playing that game indoors.

DESCRIPTION OF THE PRIOR ART

Games, other than golf, which use golf clubs and balls, or similar implements, are common. Miniature golf is one example.

U.S. Pat. No. 4,934,704 issued to Mazer shows a section of carpeting printed with indicia representing sand traps, water, grass, and the like, plus two target "holes" for playing unspecified indoor golf games. Each area of the carpet is colored to indicate a number of points, ranging from −1 to 6, scored for a ball on that area. The carpet of Mazer is flat and featureless aside from indicia.

Kantner et al. in U.S. Pat. No. 4,957,288 show a floor frame laid out like a billiards table with six pockets, but played with golf ball and clubs.

U.S. Pat. No. 4,798,385 of Tegart discloses a large indoor area, as big as a football field, for use as an indoor golf course. The course includes tees, markers and television cameras.

Paolillo, in U.S. Pat. No. 4,875,682, shows a rigid board playing area with a ball trap at either end. The floor of each trap slopes downward to trap the balls within. A golf ball can enter the trap through any one of three adjoining gates.

Carolan, Jr. describes in U.S. Pat. No. 4,596,391 his portable golf game which includes a long rectangular carpeted area which is contiguous with a hexagonal area bordered by a fence or railing. A cup inside the hexagonal area serves as a ball trap. The cup is movable to vary the difficulty of the game. Various locations are denoted on the rectangular area on which a cubical obstacle may be placed.

Golf putting practice mats which roll up are commercially available. One type is made by the Habitat company of Chattanooga, Tenn. This mat is formed of polypropylene turf. It may be rolled out on a level surface for putting practice. The mat includes a shallow ramp at either end with holes (depressions capable of trapping a slow-moving golf ball) at either end. There are no indicia on the Habitat mat which would make it suitable for games; it is intended solely for putting practice, in which the user tries to putt a golf ball into one of the holes.

None of the above inventions and patents, taken either singly or in combination, is seen to describe the instant invention as claimed.

The prior art does not disclose a game in which teams or individuals can compete using regular golf balls and clubs on a rectangular area resembling an actual section of green. Nor does it disclose golf games for teams which are easily played inside, nor games in which strategy is important.

Accordingly, the object of the present invention is a putting game using ordinary golf balls and clubs, which is challenging, affords putting practice, can be played in teams of any size, is inexpensive, and can be played in a small area.

A further object is a golf game which employs a roll-up putting mat which stores in a small space, and can be laid out indoors and then rolled up again for storage.

These and other objects of the present invention will become readily apparent upon further review of the following specification and drawings.

SUMMARY OF THE INVENTION

The golf putting game of the present invention is played with regular golf balls and clubs on an elongated rectangular playing area. The players stand at one end of the area and putt toward the far end. When putting the players must stand behind one of a series of transverse lines, which are assigned by handicap. At the end of the playing area distal the putting lines is a shallow ramp. Several holes or depressions in the surface of the ramp, called "bunkers" in the game, act as ball traps. The playing area is conveniently made up in the form of a roll-up mat. The game itself has two phases. In phase one, the players attempt to putt balls into one of the bunkers to accumulate points. Phase two of the game has three embodiments, in all of which the players attempt to land their putts in one of the last three rectangles defined by the transverse lines to score. Bunker balls do not count in phase two. Score points are counted only at the end of one or more rounds of play in two of the embodiments, which encourages strategy and "bumping" of opponents' balls out of the score rectangles. The winning team is the first to reach a certain total score in two of the embodiments, and is the team with the most points after eight rounds in the other.

BRIEF DESCRIPTION OF THE DRAWINGS

The drawing FIGURE is a perspective view of the mat used with the present invention showing balls and a club used in play.

DETAILED DESCRIPTION OF THE PREFERRED EMBODIMENTS

The present invention, shown in the drawing figure, is a golf putting game which is based on the use of ordinary golf balls 2 and putters 4 and a long rectangular playing area, which contains holes or "bunkers" 32, 34 into which the balls 2 can fall. The rectangular area is traversed by straight section lines 12–**12*h*** which define intermediate scoring areas and putting positions. The game involves putting or "lagging" balls along the length of the playing area (from right to left in the figure). Golf balls must be putted with skill to excel in the game, since the lagged balls must be placed accurately.

The playing area can be set up outdoors on turf with lime lines or other markers, or, the game can be played indoors on a special roll-up game mat 10 described below. The playing area layout and shapes are the same in either case. Only the materials will differ. In either case, standard golf balls and putters may be used to play.

The Mat: The game mat 10 is rectangular, having a length greater than its width; typical dimensions might be 20 inches wide and 6 to 20 feet long. It is made of any material which can be rolled up for storage and rolled out for play on an indoor floor or outside surface. The mat material surface must have a texture suitable for putting, such as indoor-outdoor carpeting, artificial turf made of polypropylene, or the like. A non-skid backing is preferable. The mat 10 may be a unitary member or comprise any number of separable panels which may be releasably joined, as along the section lines **12–12*h***, by VELCRO or the like.

The most important characteristic of the mat surface is its "speed" as measured with a stempmeter. A stempmeter is basically an inclined ramp down which a golf ball is rolled. The ball picks up a certain speed in rolling down, and when it meets the grassy surface of play it will roll a certain distance. This distance is a measure of the speed of the surface. On a regulation golf surface, the golf ball from a stempmeter will roll about 12 feet. By testing and selecting various carpets or other materials from which the mat might be constructed, a surface of any desired speed can be built into the mat.

The mat 10 consists of a relatively long central rectangular area as formed by the sections **24–24*d* and which is level when placed on a level surface like a floor. If an undulating surface is desired for more challenging play, the mat 10** may be placed on an uneven surface outside. For indoor play, the surface may also be made to undulate by putting artificial hills (not shown) under the mat surface. Such artificial hills could conveniently be made of urethane foam. As the various section lines will be understood to define distinct playing or scoring areas, denoted as rectangles in the instant game, these lines and/or the adjacent section surfaces may be of various identifiable colors.

The end 36 toward which the balls are putted or lagged (on the left in the figure) will herein be called the far end. Toward this far end 36 is a ramp 30 up which the putted balls 2 roll. The ramp 30 starts at a line across the mat 10 which is 30 to 36 inches from the far end 36 of the mat 10, and rises evenly toward that end 36. The height of the ramp 30 at the far end is 1 to 2 inches above the central or relatively flat area. Thus the ramp slope is very gentle. The ramp 30 is preferably formed by gluing a wedge 30 a of urethane foam onto the underside of the mat, with the sharp edge of the wedge running transversely across the mat.

Apertures are cut through the mat and into the ramp material to form hollow ball traps or open depressions 32, 34 below the surface of the mat. These traps are referred to as "bunkers" in the present invention. These bunkers are either circular holes 34 which are 4 inches in diameter, or less regular shapes 32 formed as overlapping circles, ellipses, or other shapes. The width of every bunker is 4 inches from side to side; that is, the bunkers are always bounded by lines, parallel to a long edge of the playing area, spaced 4 inches apart. The bunker length and shape is otherwise arbitrary. An oblong shape with a length of 7 inches is preferred, however.

Standard golf holes are 4 and ¼ inches in diameter. Thus the slightly smaller 4 inch bunkers 32, 34 are good for simple putting practice as well as for playing the game of the present invention.

Preferably two or more bunkers, including at least one circular bunker 34 and at least one oblong bunker 32, are included in the ramp 30. The circular bunker 34 is on the left as seen by the players, who stand on the right in the drawing figure.

The bunkers as shown favor right-handed putters. An alternative embodiment might be two oblong holes, set at equal distances from the end. This would make the mat 10 equally suited to right and left-handed players.

An alternative embodiment of the mat 10 might omit the ramp and use a mat uniformly thick enough to accept depressions forming the bunkers 32, 34. In addition, a thin mat 10 with no ramp could use elevated rims to form the ball-trapping bunkers.

As described, the various straight section lines **12–12*h* are marked across the mat for play and scoring. All lines are mutually parallel and transverse to the length of the mat 10, meeting the long edge of the mat 10 at 90 degrees. The lines 12 are located at the following approximate distances from the far end 36 of the mat 10: 8 inches, 24 inches, 40 inches, 76 inches, 96 inches, 116 inches, 136 inches, and 144 inches. The lines 12** are preferably color-coded as follows: 76 inches, red; 96 inches, white; 116 inches, blue; 136 inches, black.

These colored lines are related to the players' handicaps, in that the farther away from the far end 36 the line is, the more difficult it is to score when putting from behind that line. Most women would play on the red line, and most men on the white line. More accomplished players would play the blue line, and top amateurs and professionals would play the black line. Individuals could adjust their color-line handicaps in accordance with their scores in the game and quite obviously, any other spacing and color designations may be used.

As mentioned, the mat 10 can be made in sections attached with Velcro or similar fasteners which run along the section lines. This allows changing the length of the playing area or juggling lengths of sections between the lines, should this be desired.

The lines **12–12*h* are seen to set out a plurality of rectangles or areas 21–23 and 24*a*–24*d*. All share a width, but but have various lengths. The rectangles 21–24** abut to make up the playing area.

In a game the players place golf balls 2 onto the area behind one of the colored lines **12–12*c*, which are adjacent one of the rectangles 24*a*–24*d* and distant from the far end 36. They putt or lag them forward in the direction of the far end. The three areas 21, 22, 23 closest to the far end 36 are scoring rectangles; together these three make up the scoring area, within which the bunkers 32, 34 must be located. A ball 2** inside the scoring area can give a player's team points in the game.

Balls 2 that roll off the end or sides of the playing area are stopped by a ball stop 40, which can be made of any suitable material, for example, 1 inch by 4 inch wooden boards arranged as shown in the drawing figure. More sophisticated versions could include gutters and ramps to return the balls 2 that fall off the playing area, or, a special plastic ball stop which catches and holds all balls coming to the far end 36.

The bunkers 32, 34 are preferably located in the two farthest scoring rectangles 21, 22. Alternate embodiments, including variations having bunkers in all three scoring rectangles, only a single round hole, and so on, are within the scope of the invention.

If the mat 10 is long enough, a second ramp 30 could be placed at the opposite end and play could progress in both directions.

The Game: The game of the present invention is a game of skill involving putting or lagging a golf ball 2 toward target bunkers 32, 34 or target rectangles 21–23. It involves strategy, as will become apparent. It can be played by any even number of players, who are divided into two teams. (In the discussion below, "team" may refer to only one person if there are only two people playing.) The game has two phases. The second phase has three embodiments.

Phase 1: The first phase, having only one embodiment, requires at least one designated scoring bunker within the last three rectangles of the playing area, preferably the circular bunker 34. Each player putts three balls 2 from behind his or her respective handicap line 12 toward the designated bunker with the aim of trapping the balls 2 in the designated bunker; each ball 2 lagged into the designated bunker counts ten points for that player. After the set of three putts, the score is added to the player's team accumulated score, the balls are retrieved from the playing area, and the next player in sequence putts. Players of opposing teams alternate in putting three balls each. After all of the players have each putted a set of three balls, the sequence of players repeats from the beginning so that each player ends up putting six balls and earning as many as 60 points for his or her team.

Phase 2: the second phase of the game requires golf balls of two different colors (or other distinguishing difference of appearance, eg., different markings). One color is assigned to each team. The players again putt from behind their respective handicap lines 12, but the intent here is different: the bunkers 32, 34 are now to be avoided. The aim is rather to have the balls come to rest within one of the three scoring rectangles 21, 22, 23 outside of the bunkers. (Scoring varies with the embodiment; see below.) Balls 2 which roll off the end or sides or which stop short of the first rectangle, as well as those fallen into the bunkers, are not counted.

Scoring is only done following a "round" in which all players putt their sets, the players putting sequentially. Therefore, a ball 2 which is hit, knocked or bumped by the ball of another player, of either team, before the end of the round, loses its original point value and takes on the value of the place where it ends up. For example, a ball bumped from the 20-point rectangle into a bunker 32, 34 loses all its point value for the team of the player who putted it into the bunker.

To avoid being bumped players may hook or slice their balls around to the far side of a bunker in the "shadow zone." This makes it harder for the opposing players to bump the shadowed balls out of the scoring regions. Strategy can be sophisticated: for example, if a bunker becomes full of balls, a player can bounce a ball over the top to bump a competitor's ball on the other side.

Because of the possibility of one's balls being bumped, it is an advantage to go first in phase two. Hence, the team with the lowest score from phase one, goes first in phase two.

The three embodiments of phase two of the game are explained below.

1. The first embodiment of phase two comprises rounds of three player sequences, and sets of one ball per player. Opposing team members putt their single balls alternately, and each player putts three balls in total during a round. For example, in a game in which the two teams had two players each, the play would go as follows: player one of team A putts a white ball; player one of team B putts a yellow ball; player two of team A putts a white ball; player two of team B putts a yellow ball (to finish the player sequence); player one of team A putts a white ball; player one of team B putts a yellow ball; and so on until each player has putted three balls. This sequence constitutes a "round" of play.

After each round scoring points are calculated and accumulated into the total left from phase one. In the first embodiment balls 2 in the three scoring rectangles 21, 22, 23 are counted as follows: a ball in the farthest rectangle 21, at the end of the playing area, is worth 30 points; a ball in the next area 22 is a 20-point ball; and the third rectangle 23 is a 10-point area. However, not all of the balls 2 which are present in the three areas at round's end are counted. The scoring is biased by the which team's ball is closest to the far end 36 of the playing area (at the edge of the 30-point rectangle 21) when play stops at the end of the round: this closest ball is called the biasing ball. If the biasing ball belongs to team A, then only team A will score points on that round.

Before scoring points for the round, another determination is made among the "adverse" balls, that is, balls belonging to the non-scoring team of that round (team B). The leading adverse ball in each of the three scoring rectangles 21, 22, 23 is determined to be that adverse ball which is closest to the far end 36. The leading adverse ball in the first rectangle 21 is the leading first adverse ball, and so on for the other two rectangles 22, 23.

The score of team A will then be figured by counting in each rectangle 21, 22, 23 all and only those balls of team A which are closer to the bordering end (distal the players) of that rectangle than is the ball of team B which is closest to the far border of that same rectangle, that is, the leading adverse ball. This number of balls within each scoring rectangle 21, 22, 23 is multiplied by the corresponding number of points for that rectangle: 30 in the first rectangle, 20 in the second rectangle, and 10 in the third rectangle.

For example, suppose that in the 20-point rectangle team A has a ball 1 inch from the far border of that rectangle, another ball 3 inches from the border, and another 5 inches from the border, while team B has balls at 4 inches, 8 inches and 11 inches from the border. If team A has the biasing ball closest to the far end of the 30-point rectangle, then team A gets 20 points for the ball at 1 inch and 20 for the ball at 3 inches for a total of 40 points, and B gets none. If B has the biasing ball, then they still get no points from the 20-point rectangle because none of their balls are beyond the farthest A team ball in the 20-point rectangle (located at 1 inch). The A team gets no points either in this case.

A similar procedure would be followed in each of the three scoring rectangles, including the end rectangle wherein the biasing ball lies. The summed scores are accumulated by the scoring team, which has the biasing ball.

After scoring is completed for a round, the balls are all removed from the playing area and another round commences.

The points calculated at the end of each round in phase two are added onto the score from phase one. One round follows another until one team accumulates a predetermined number of points, for example 210 points. That team wins the game.

2. The second embodiment of phase two is exactly like the first embodiment except that each player shoots three balls in succession in each set of putts. That is, player one of team A putts three balls; then player one of team B putts three balls; then player two of team A putts three balls; then player two of team B putts three balls; and so on. The scoring is as described above for the first embodiment of phase one, and is done after each round. In each round, each player putts one set of three balls.

The second embodiment of phase two will replace rather than succed the first embodiment of phase two. The complete game is always a combination of the phase one part of the game and the phase two part, where the phase two part is chosen from one of the three embodiments. The replacement is at the discretion of the players.

As in the first embodiment, the team which first reaches a certain points total wins the game. 3. In the third embodiment of phase two the players putt in the sequence of the second embodiment, each putting 3 balls in each set. However, in the third embodiment the balls are removed from the playing area after each player's putts, leaving it clear for the next player.

Each player accumulates points after his or her 3 putts according the following scheme: a ball in the farthest rectangle is worth 10 points; one in the middle rectangle is now worth 6 points; and one in the former 10-point rectangle is now worth only 2 points. The points from each ball are added to a team's previous score. As before, no points are scored for balls in the bunkers.

Aside from the scores, another difference is that the number of rounds is not open-ended. Instead of reaching a predetermined winning score to win, the team with the most accumulated points at the end of 8 rounds is the winner.

Each player has a chance of scoring a game total of 300 points in the third embodiment. 60 points could accumulate in phase one, and 3 putts into the farthest rectangle on each of eight rounds would yield 10 points/ball, times three balls/round, times eight rounds, or, 240 points altogether.

Apart from the enjoyment the game affords to players, it is excellent practice for regular golf playing. When putting the ball toward a bunker, the shot is slightly harder than the same shot in regular golf, because of the slightly smaller size of the bunker (4 inches as opposed to 4 and ¼ inches). Also, since bumping is such an important strategy in the game of the present invention, players often aim for an even smaller target, the ball itself, which is only 1 and ⅝ inches in diameter.

The present game has the advantages of requiring a small space, and of using any open area on which the mat may be rolled out. It uses very few resources, in comparison to a game like bowling, which requires hardwood alleys, complex and expensive machines, a building in which to put the alleys and machines, and a parking lot for the cars which drive to the building. In places which are crowded, the advantages of the present invention in saving space could be a boon. If play were in leagues, players could easily practice on a regulation mat at home. The mat of the present invention will fit into a three-suiter travel suitcase. The game can be played in any weather and in almost any place.

The game may also be used for comparing performance of various putting clubs. A golfer could play against himself, alternating clubs when taking the parts of the opposing sides. If one side "won" consistently, this would tend to show that club to be better.

It is to be understood that the present invention is not limited to the sole embodiment described above, but encompasses any and all embodiments within the scope of the following claims.

I claim:

1. A method of playing a golf game for an even number of players comprising the steps of:

providing golf clubs;

providing golf balls of two distinguishing appearances;

providing an elongated rectangular playing area including a far end transverse to the length of said playing area, a plurality of contiguous rectangles all having a transverse width, said rectangles mutually abutting along intermediate transverse edges, said edges defining straight lines perpendicular to the length of said rectangular playing area, a scoring area including a first scoring rectangle adjacent said far end, a second scoring rectangle abutting said first scoring rectangle along a first one of said lines, and a third scoring rectangle abutting said second scoring rectangle along a second one of said lines, said third scoring rectangle bordered by a third one of said lines distal said second one of said lines, and bunkers within the scoring rectangles, said bunkers adapted to hold a golf ball rolling thereinto;

assigning a first number of points to balls coming to rest within said first scoring rectangle;

assigning a second number of points to balls coming to rest within said second scoring rectangle;

assigning a third number of points to balls coming to rest within said third scoring rectangle;

assigning a fourth number of points to balls coming to rest within a designated one of the bunkers;

arranging a sequence of players, wherein two teams of players alternate;

playing a first phase of said game wherein the players, according to said sequence, place said balls on said playing area outside of said scoring area and adjacent one of said lines distal said far end, and putt said balls with said clubs toward said far end, to score points to their respective teams by emplacing balls within a designated bunker;

playing a second phase of said game wherein the players, according to said sequence, place said balls on said playing area outside of said scoring area and adjacent one of said lines distal said far end, and putt said balls with said clubs toward said far end, to score points to their respective teams by emplacing balls within the scoring rectangles and outside the bunkers; and summing points scored by each team to determine a winning team.

2. A game as in claim 1 wherein said first phase includes the step of progressing twice through said sequence of players, and within each player's turn performing the futher steps of:

putting a set of three of said balls toward a designated one of the bunkers;

removing all of said three of said balls from said playing area;

scoring said fourth number of points to the team of the putting player for each one of said three of said balls coming to rest within said designated bunkers; and adding scored points to a respective team score.

3. A game as in claim 1 wherein said second phase further comprises the steps of:

assigning balls of a first distinguishing appearance to a corresponding respective first team;

assigning balls of a second distinguishing appearance to a corresponding respective second team;

playing three rounds of progressing once through said sequence of players, each one of the players in turn putting a set of one ball of a respective assigned color toward said scoring area;

scoring said three rounds by determining a biasing ball, said biasing ball being closest of all the putted balls to said far end, electing a scoring team corresponding to the respective distinguishing appearance of said biasing ball, scoring to said scoring team a number of points equal to said first number of points multiplied by the number of balls of said scoring team within said first scoring rectangle which are closer to said far end than is a leading first adverse ball, said leading first adverse ball closest to said far end of any of a group of first adverse balls not of said scoring team within said first scoring rectangle, scoring to said scoring team a number of points equal to said second number of points multiplied by the number of balls of said scoring team within said second scoring rectangle which are closer to said far end than is a leading second adverse ball, said leading second adverse ball closest to said far end of any of a group of second adverse balls not of said scoring team within said second scoring rectangle, and scoring to said scoring team a number of points equal to said third number of points multiplied by the number of balls of said scoring team within said third scoring rectangle which are closer to said far end than is a leading third adverse ball, said leading third adverse ball closest to said far end of any of a group of third adverse balls not of said scoring team within said third scoring rectangle;

removing all the balls from the playing area; and repeating the previous steps of playing three rounds, scoring, and removing until a winning team accumulates scored points equal to or greater than a winning score.

4. A game as in claim 1 wherein said second phase further comprises the steps of:

assigning balls of a first distinguishing appearance to a corresponding respective first team;

assigning balls of a second distinguishing appearance to a corresponding respective second team;

playing one round of progressing once through said sequence of players, each one of the players in turn putting a set of three balls of a respective assigned color toward said scoring area;

scoring said round by determining a biasing ball, said biasing ball being closest of all the putted balls to said far end, electing a scoring team corresponding to the respective distinguishing appearance of said biasing ball, scoring to said scoring team a number of points equal to said first number of points multiplied by the number of balls of said scoring team within said first scoring rectangle which are closer to said far end than is a leading first adverse ball, said leading first adverse ball closest to said far end of any of a group of first adverse balls not of said scoring team within said first scoring rectangle.

scoring to said scoring team a number of points equal to said second number of points multiplied by the number of balls of said scoring team within said second scoring rectangle which are closer to said far end than is a leading second adverse ball, said leading second adverse ball closest to said far end of any of a group of second adverse balls not of said scoring team within said second scoring rectangle, and scoring to said scoring team a number of points equal to said third number of points multiplied by the number of balls of said scoring team within said third scoring rectangle which are closer to said far end than is a leading third adverse ball, said leading third adverse ball closest to said far end of any of a group of third adverse balls not of said scoring team within said third scoring rectangle;

removing all the balls from the playing area; and repeating the previous steps of playing a round, scoring, and removing until a winning team accumulates scored points equal to or greater than a winning score.

5. A game as in claim 1 wherein said second phase further comprises the steps of:

playing eight rounds of progressing once through said sequence of players, each said round further comprising a sequence of turns of the players, each turn further comprising putting a set of three balls toward said scoring area, scoring after the set is putted by scoring to the team of the player who putted a number of points equal to said first number of points multiplied by the number of balls within said first scoring rectangle, scoring to the team of the player who putted a number of points equal to said second number of points multiplied by the number of balls within said second scoring rectangle, scoring to the team of the player who putted a number of points equal to said third number of points multiplied by the number of balls within said third scoring rectangle, and removing all the balls from said playing area after the set is putted; and deciding a winning team, said winning team having a greatest number of accumulated points after said eight rounds are played.

6. A game as in claim 1 wherein said bunkers are four inches wide.

7. A game as in claim 1 including a ramp inclined from said playing area to said far end, said bunkers disposed over said ramp.

8. A game as in claim 1 wherein said playing area includes a roll up mat.

9. A game as in claim 1 including a ball catcher adjacent said far end.

* * * * *